United States Patent [19]

Vowell

[11] 4,201,389

[45] May 6, 1980

[54] WORD GAME

[76] Inventor: David H. Vowell, 11427 Sunshine Ter., Studio City, Calif. 91604

[21] Appl. No.: 42,023

[22] Filed: May 24, 1979

[51] Int. Cl.[2] ..... A63F 3/00

[52] U.S. Cl. ..... 273/272; 35/77; 273/281; 273/289

[58] Field of Search ..... 273/237, 272, 281, 282, 273/289, 155; 35/77; 40/447, 449, 503, 504, 468, 469

[56] References Cited

U.S. PATENT DOCUMENTS

| | | | |
|---|---|---|---|
| 52,758 | 2/1866 | Skinner | 35/77 |
| 2,698,181 | 12/1954 | Kitovich . | |
| 2,842,368 | 7/1958 | Williams | 35/77 X |
| 3,129,004 | 4/1964 | Ritzler . | |
| 3,463,487 | 8/1969 | Tepper . | |
| 3,735,982 | 5/1973 | Gerfin . | |
| 3,902,725 | 9/1975 | Massicotte . | |

FOREIGN PATENT DOCUMENTS

| | | | |
|---|---|---|---|
| 647975 | 8/1928 | France | 273/155 |
| 1191186 | 4/1959 | France | 273/272 |

*Primary Examiner*—Anton O. Oechsle

*Attorney, Agent, or Firm*—Poms, Smith, Lande & Rose

[57] ABSTRACT

A word game comprising a playing surface having a plurality of sections, each section being adapted to present a different letter viewable to the player, the various sections being capable of being maintained in a fixed position whereby aligned letters may be used to form a word, the remaining sections being capable of being varied to present a plurality of different letters viewable to the player or players. Optionally, the letters are dispersed on the playing surface in a manner correlated to their frequency of appearance in the English language with certain related letters being placed in juxtaposed relationship.

8 Claims, 7 Drawing Figures

WORD GAME

BACKGROUND OF THE INVENTION

1. Field of the Invention

The invention relates to word games; and, more particularly, to a game wherein aligned letters on a playing surface are used to form a word, the remaining letters being changed to present differing randomly disposed letters to either the same or a subsequent player, the originally formed word being retained on the playing surface.

2. Description of the Prior Art

Many types of word puzzles and word games are known in the game art. Such games have maintained their popularity over the years. In some of these games, tiles or squares are placed on a playing surface to form interlocking words. In other games, dies having differing letters are used to form various words on a playing surface. In some word games, such as crossword puzzles, letters are filled into a playing surface which, when completed, presents an interlocking arrangement of words.

Obviously, there is considerable interest in games of this type and the public is always looking for new and unique word games. Such games should preferably be relatively inexpensive and easy to understand. It is also of advantage if such games can be played by one player alone or by players of differing intellectual capacity.

SUMMARY OF THE INVENTION

It is an object of this invention to provide a new and unique word game which enables a player to form a word from a plurality of randomly disposed letters on a playing surface, lock the formed word in position, rearrange the remaining letters and allow the same or a subsequent player to form a second word.

It is another object of this invention to provide such a word game which can be provided in either a mechanical or electrical form.

It is still another object of this invention to arrange the letters on the playing surface in a manner correlated to their frequency of appearance in the English language.

It is still further an object of this invention to arrange certain letters on the playing surface in juxtaposed position to related letter combinations found in the English language.

These and other objects are preferably accomplished by providing a playing surface having a plurality of sections, each section being adapted to present a different letter viewable to the player, the various sections being capable of being maintained in a fixed position whereby aligned letters may be used to form a word, with the remaining sections being capable of being varied to present a plurality of different letters viewable to the player or players. Optionally, the letters are dispersed on the playing surface in a manner correlated to their frequency of appearance in the English language with certain related letters being placed in juxtaposed relationship.

DESCRIPTION OF THE PREFERRED EMBODIMENT

Figure 1:
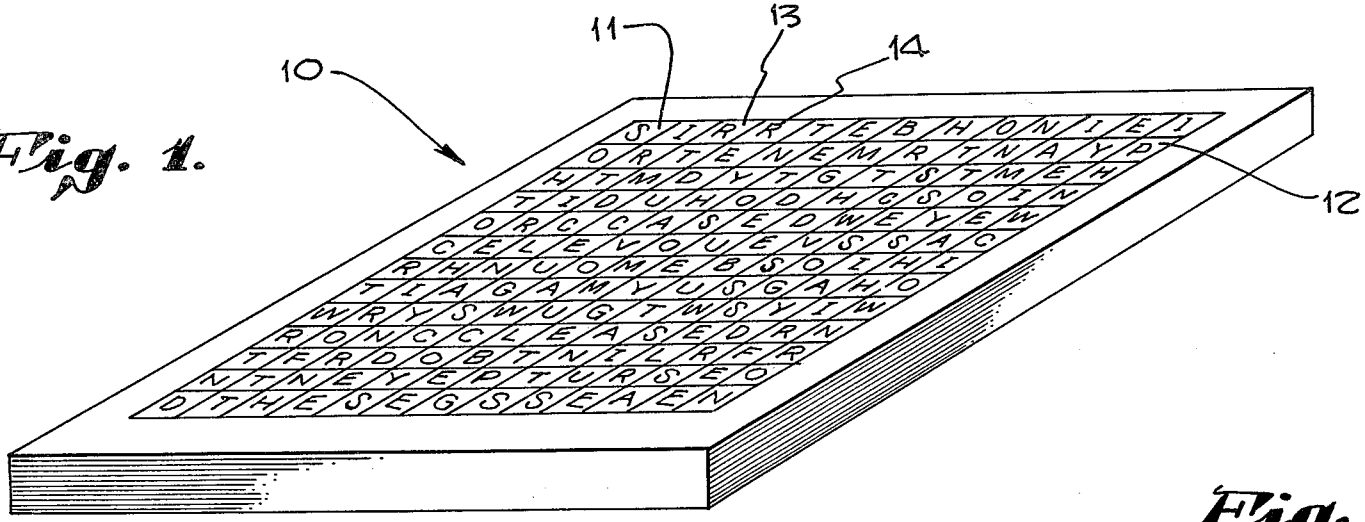
FIG. 1 is a perspective view of a game board in accordance with the teachings of my invention.

Referring now to FIG. 1 of the drawing, a game board 10 in accordance with the teachings of my invention is shown having a plurality of aligned vertical rows 11, such as thirteen such rows, and a plurality of aligned horizontal rows 12, such as thirteen such rows, thus dividing the game board playing surface into a plurality of sections 13. As can be seen in FIG. 1, a letter 14 is visible in each section 13. Since there are one-hundred and sixty-nine sections 13, there are a like number of letters 14. The letters 14 are randomly selected, as will be discussed, presenting many possibilities of forming words. For example, the first three horizontal letters to the left of FIG. 1 in the first horizontal row 12 spell the word "sir".

Each section 13, in the game board of FIG. 1, is comprised of a block 15 (FIG. 2) which may be either removable or an integral part of game board 10. As shown, a window or cut-out portion 16 is formed in each block 15 displaying the letter 14 therethrough.

Figure 2:
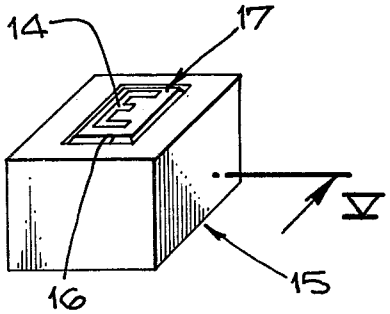
FIG. 2 is a perspective view of one of the blocks of the game board of FIG. 1.
Figure 3:
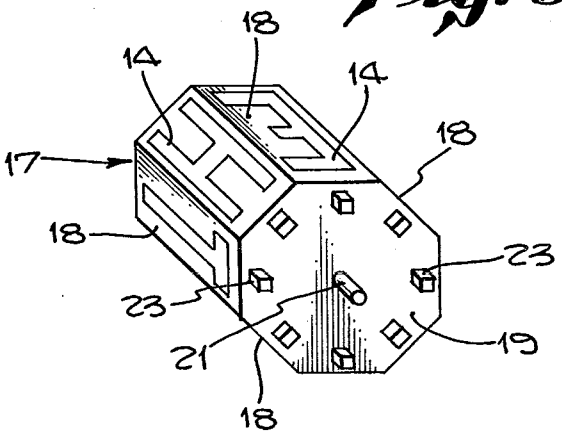
FIG. 3 is a perspective view of the rotor of the block of FIG. 2.
Figure 4:
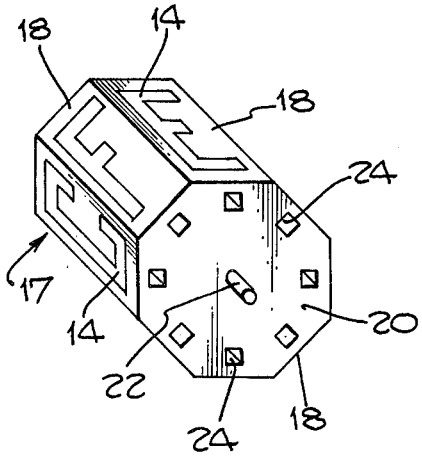
FIG. 4 is a perspective view of the side opposite that of FIG. 3 of the rotor.

In FIG. 2, the letter 14 is disposed on a rotor 17 (see also FIGS. 3 and 4) which has a plurality of faces 18, e.g., eight, thereby being octagonally-shaped, each face 18 having a letter 14 thereon (as, for example, letters "T", "H" and "E" in FIGS. 3 and 4). Each end face 19, 20 (FIGS. 3 and 4) terminates in a protruding pin 21, 22 respectively (pins 21, 22 may of course be a single elongated axially extending pin). Face 19 includes a plurality of protruding locking pins 23, irregularly spaced in cross-section, surrounding central pin 21. Face 20 includes a plurality of slots or apertures 24, configured as pins 23, surrounding central pin 22.

Figure 5:
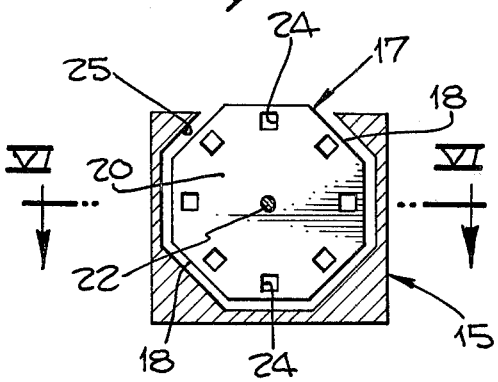
FIG. 5 is a view taken along lines V—V of FIG. 2.
Figure 6:
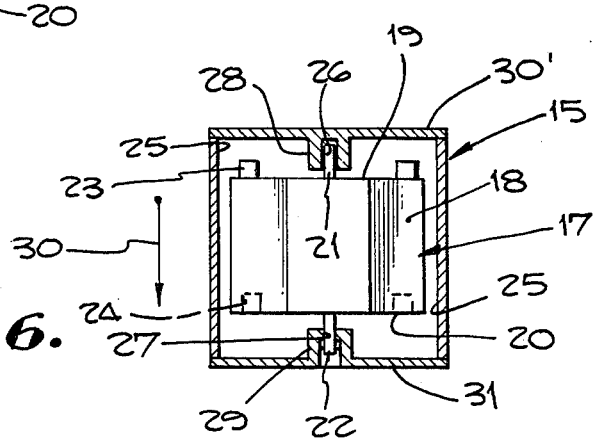
FIG. 6 is a view taken along lines VI—VI of FIG. 5.

FIG. 5 shows rotor 17 disposed in block 15 with sufficient clearance between the rotor 17 and the inner wall 25 of block 15, which is configured as the outer configuration of block 15, to permit block 17 to rotate freely. FIG. 6 shows pins 21, 22 journaled for rotation in apertures 26, 27 formed in abutment portions 28, 29, respectively, on the inner wall 25 of block 15. As will be discussed, sufficient space or leeway is provided in apertures 26, 27 to permit each rotor 17 to be pulled downwardly in the direction of arrow 30 (FIG. 6) as will be discussed.

Figure 7:
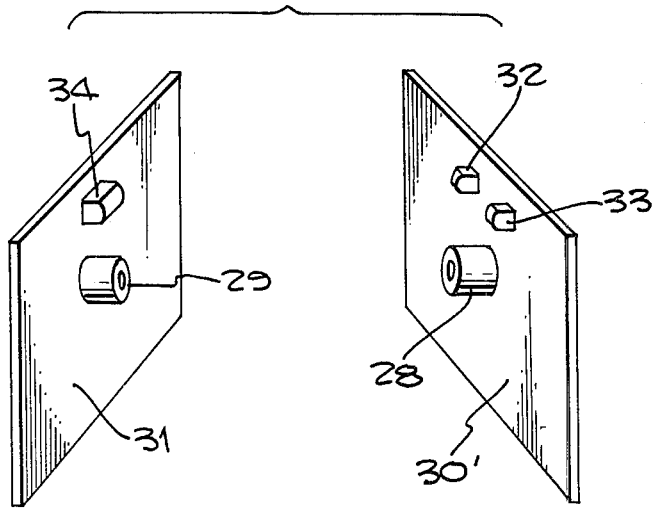
FIG. 7 is an exploded view of a portion of the apparatus of FIG. 6.

Wall portions 30', 31 of block 15 are shown in detail in FIG. 7. A pair of spaced positioning pins 32, 33 are provided on wall 30' above abutment portion 23 where a single locking pin 34, configured as slots 24, is provided on wall 31 above abutment portion 29.

In operation, when in the FIG. 6 position, rotor 17 is manually spun about the axis of pins 21, 22 and freely spins until it comes to a rest. Pins 23 ratchet about pins 32, 33 (FIG. 7), thereby positioning the letter visible to the player in the manner shown in FIG. 2. That is, pin 23, below the E in FIG. 3, ends up between pins 32, 33 (FIG. 7).

In order to lock a preselected letter in position, rotor 17 is pulled downwardly in the direction of arrow 30 in FIG. 6 until locking pin 34, on wall 31, enters one of the slots 24 on face 20 of rotor 17 (FIG. 4). For example, pin 34 enters the slot 24 directly below the letter E in FIG. 4. Since the pin 34 is configured as slots 24, engagement therein prevents rotation of rotor 17 when the remaining rotors of FIG. 1 are rotated.

Of course, any suitable number of blocks and rotors may be used. Also, any suitable materials, such as various woods and plastics, may be used to form game board 10 and the various components of the block 15 and rotor 17. Although an octagonally-shaped rotor 17 has been disclosed, obviously any suitable number of faces may be provided. Also, although various configured pins and slots 23, 24, 32 through 34, have been disclosed, other positioning and locking means may be used.

OPERATION

A preferred game using the game board 10 described in FIGS. 1 through 7 is as follows. The game begins with all the sections 13 having letters 14 as visible in FIG. 1. Although the game will be described with respect to more than one player, obviously a single player may play a solitaire-type word game. In any event, the first player looks for contiguous letters to form a single word. This word can be any number of letters in length and anywhere on the board. Although the rules may be varied, as discussed, the word must extend vertically, horizontally or diagonally, reading only from left to right, only from right to left, only from top to bottom or only from bottom to top. Once the player locates his word—and there may be more than one such choice on the board—he pulls downwardly each rotor 17 bearing a letter of his word thereon in the direction of arrow 30 in FIG. 6 until it locks into engagement with pin 34. He records his score, as will be discussed, then spins or otherwise manipulates the remaining displayed letters so as to rearrange them randomly. For example, looking at game board 10 in FIG. 1, the first player may elect SIR as previously discussed, lock in the rotors bearing these letters, and spin the remaining letters to present an entirely new array of randomly dispersed letters save for SIR.

The next player then takes a turn and is thus presented with a new and different display of letters since only those selected by the previous player remain in a fixed position. He then selects his word, which may or may not intersect a prior locked-in word, spins the remaining letters and passes the game board 10 on to a subsequent player. Play continues until all squares are locked or to a time mutually agreed upon by the players.

SCORING

Although of course scoring may be varied, each 1 letter may be worth a single point. However, if a new word intersects or adds to an existing word previously played by any player, then the player counts the words so intersected or added to as part of the new score. The higher score wins.

The squares or sections 13 of the game board of FIG. 1 may all be of the same size. The letters of the alphabet appearing on the faces of the rotors may be distributed according to statistical analysis of their appearance in the language in which the game is to be displayed. The game is not limited to any specific number of squares or sections 13 and the total number of faces of the rotor 17 may vary without affecting the basis game concept. Obviously, there is a correlation between the total number of letters per rotor and the total number of squares or sections, the number of each letter of the alphabet to be distributed among the rotors being determined by a statistical analysis of the frequency of the appearance of each letter in the language in which the game is to be played. For example, in the game board 10 of FIG. 1, there are eight letters per rotor and one hundred and sixty-nine rotors, or 1352 letters. In the English language, the percentage of distribution may be as follows (Frequency of Appearance in English taken from the Encyclopedia Britannica):

CHART I

| | ALPHABET DISTRIBUTION | |
|---|---|---|
| LETTER | FREQUENCY OF APPEARANCE IN ENGLISH | ACTUAL NUMBER OF LETTERS IN GAME BOARD OF FIG. 1 |
| A | 7.25 | 96 |
| B | 1.25 | 16 |
| C | 3.25 | 44 |
| D | 4.00 | 54 |
| E | 13.00 | 176 |
| F | 3.00 | 40 |
| G | 1.75 | 24 |
| H | 3.25 | 44 |
| I | 7.75 | 102 |
| J | 0.25 | 3 |
| K | 0.25 | 3 |
| L | 3.75 | 50 |
| M | 2.50 | 34 |
| N | 7.75 | 102 |
| O | 7.25 | 102 |
| P | 2.75 | 36 |
| Q | 0.25 | 3 |
| R | 8.25 | 110 |
| S | 5.75 | 78 |
| T | 9.00 | 120 |
| U | 3.00 | 40 |
| V | 1.25 | 16 |
| W | 1.50 | 20 |
| X | 0.50 | 6 |
| Y | 2.25 | 30 |
| Z | 0.25 | 3 |
| | 100.00% | 1352 |

Based on this statistical analysis, letters of the alphabet are distributed among the faces of each of the rotors 17 contained on the game board 10 of FIG. 1. For the English language, for example, the 1352 letters may be distributed on the faces of rotors 17 as follows (each grouping of eight letters corresponding to a rotor 17 in the game board 10 of FIG. 1):

CHART II

| LETTER DISTRIBUTION | | | | | | | | | | | | |
|---|---|---|---|---|---|---|---|---|---|---|---|---|
| MDSA | CANI | HDOI | SAON | WSNI | MHSO | BGPC | MHLS | WSON | SAON | HDNE | CAOI | YMDS |
| IRET | RETT | RETT | IRET | RETT | NIRE | SANE | OIRE | IRET | IRET | IRTT | RETT | ANIE |
| PAOI | AONI | VSNI | HANI | FANI | CANI | YMPL | WCOI | VFON | HANI | SAIR | YAOI | PANI |
| RETT | RETT | RETT | RETT | RETT | RETT | DANE | RETE | IRET | RETT | ETEE | RETR | RETT |
| HDNI | PFSN | MPUF | DAOI | YUCS | HANI | GMUD | HYNI | SUCO | DAON | MPUF | PFLS | HDOI |
| RETT | IRET | LDAE | RETT | NIRE | RETT | ATOE | RETT | NIRE | IRET | DANE | NIRE | RETT |
| SAOI | FHNI | XPHI | YUFC | QPFH | GPUA | BGHD | GPUL | JXPF | YUFC | PHLD | FHSO | SAON |
| TRET | LRET | DORE | DSAE | CLSE | OHRE | SAOE | AONE | HCBE | LDOE | SONE | NIRE | IRET |

CHART II-continued

LETTER DISTRIBUTION

| | | | | | | | | | | | | |
|---|---|---|---|---|---|---|---|---|---|---|---|---|
| WAIO | DAOI | YFHC | FCLS | WMUF | BVPL | GYLD | BVPL | WMUF | FCLS | YFHC | LDAO | WATO |
| RETT | RETT | NIRE | ONRE | AONE | DSOE | SAOE | DINE | SAOE | ONIE | LONE | NIRE | NIRE |
| MCBD | HANI | VLSO | WGYU | QVMF | MULS | WUHS | ZMUL | ZVMF | GYUL | VSAO | WHNI | MCDS |
| SONE | RETE | ANIE | LDNE | CSTE | AORE | AONE | SANE | CLAE | DSNE | NIRE | RAET | ONIE |
| GMCA | YPHC | XGMU | BGUC | GYPL | XVMU | ORET | VBMU | KZGY | GADS | GMUA | YPHC | GMCL |
| NIRE | BLDE | LSNE | DSOE | SROE | HANE | RTEE | HCLE | PLSE | ONIE | ONIE | DSOE | ANIE |
| RDSO | AONI | SVFC | GYNL | JILS | MOSA | PUAS | BMUS | JVPF | GYUD | FCSU | HLOI | CLDS |
| NIET | RETT | ANRE | DFET | AOUE | NIRE | YTNE | AORE | SAOE | LOIE | AONE | RAET | ONIE |
| WAIH | DAOI | YFHL | BFCL | WMUF | PLDS | GYDS | PDSO | WMUF | BFCL | YFHL | DAON | WANI |
| RCSE | RETT | NORE | SONE | CSAE | UONE | HAOE | NITE | CAOE | SORE | ONRE | IRET | RETT |
| EAON | PFAO | XWPD | YUFC | KQPF | GPUA | WBGH | WGPU | KXPF | YUFC | WPDO | PFON | SAON |
| IRTT | NIRE | ONRE | LDSE | HCRE | ONLE | DSIE | CAOE | ILSE | IDSE | NIRE | ARET | IRET |
| HDAI | FHLS | MPUD | DAON | YULA | BHLA | GMUL | BHLA | YUSO | LDAN | MPUD | FHLS | HDAO |
| RETT | IRET | ATRE | IRET | CSOE | NIRE | DATE | ONRE | CNIE | IRET | AORE | ONRE | NIRE |
| MANI | ANIR | VSNI | HANI | VFYO | MCNI | DYPA | MCON | VFUO | HAON | VYST | AUOI | MAON |
| RETT | ETRT | REOT | RETT | IRET | RETT | ONRE | IRET | IRET | IRET | NIRE | RETT | IRET |
| YDSA | PCIR | HAOI | SAON | WSOI | SAOL | MGCO | HSON | WSOI | SAON | HAOI | PCON | DSAN |
| IRET | ETTE | RETT | IRET | TRET | NRET | SATE | RETT | RETT | IRET | RETT | IRET | IRET |

Far from being randon, the letters of the alphabet distributed among the rotors in the game board of FIG. 1 are placed in a symetrical and pre-determined pattern. For example, the rotors 17 containing the letter "Q" are adjacent to rotors 17 containing the letter "U". The positions of the letters "C" and "L" in relationship to the letter "K" serves as another example. Upon study of Chart II, other combinations will be noted. Thus, the placement of letters takes into consideration the percularities of the English language, i.e., without a "u" adjacent a "q", the "q" would be useless. Other percularities are taken into consideration e.g., the location of letters adapted to form diphthongs.

The word-forming combinations possible through the random manipulation of these letter-bearing rotors 17 are virtually endless. For example, eight letters per rotor in each of 169 different squares provides for an exponential variation, i.e., $13^8$. Additional permutations are created when any of the rotors is exchanged with any other in the board.

ELECTRONIC GAME

Although the game board of FIG. 1 has been described as a mechanical game, obviously present-day electronics may be used to carry out the concept of my invention. For example, conventional LED crystals may be used in place of the rotors 17, such crystals being programmed to include all twenty-six letters of the English alphabet (as opposed to only eight letters on each rotor 17). Again, the frequency of appearance of each letter in each square or section having such crystals therein can be predetermined by the same analysis as set forth in Chart I, such percentages of letters being used to program the crystals. Conventional matrix control means can be used to lock in and clear each crystal as is well known in electronics. Of course, the playing and scoring may be the same as for game board 10.

Of course, many variations in play will occur to an artisan. For example, words may be made either horizontally, vertically, left to right, right to left, top to bottom, bottom to top, diagonally in either direction, etc., or any combination thereof. One or more players may play and any one rotor 17 may be interchanged with any other rotor on game board 10 to present even more variety. If desired, indicia may be imprinted on the board 10 to indicate the preferred placement of each rotor 17.

Although the game has been described with respect to English, it may be used in any other language. In fact, easily removable letters may be provided for temporarily inserting letters or letter forms pecular to a language. Alternatively, separate rotors may be made available which will easily snap fit into each section 13 to provide for the pecularities of that particular language.

It can be seen that I have described a game which is adaptable to any language and which is new and interesting and can be quickly and easily learned. It can be played by one or more players, and is capable of wide variations and playable by players of different intellectual ability.

I claim:

1. A game board comprising:

a plurality of sections;

letter means associated with each of said sections containing thereon a plurality of individual letters, said letter means being adapted to present only a single pre-selected letter viewable to a player, said letter means including a plurality of rotatable elements, each of said elements having a plurality of faces thereon, each of said faces having only a single letter displayed thereon, said letter means also including a block in each of said sections;

letter changing means on said game board for varying said letter means for changing the letter viewable to a player to another differing letter on said letter means viewable to said player, said letter changing means including said elements being rotatably mounted in said blocks to thereby present differing faces thereof viewable to a player; and letter locking means on said game board for locking in a pre-selected letter viewable to said player thereby permitting a plurality of aligned juxtaposed letters to be locked into fixed position while the remaining letters are varied.

2. In the game board of claim 1 wherein said sections includes a plurality of vertical and horizontal rows on said game board.

3. In the game board of claim 1 wherein said letter locking means includes means associated with both said element and said block wherein, in a first position, said element is freely rotatable in said block, and, in a second position, said element is lockable in a fixed position in said block.

4. In the game board of claim 3 wherein said last-mentioned means includes at least one locking pin on said block adapted to enter at least one locking slot in said element, both said locking pin and said locking slot being irregularly configured.

5. In the game board of claim 3 wherein said block includes a pair of spaced apertured bosses therein, said element including an axially extending pin entering said bosses, sufficient play being provided between said bosses and said last-mentioned pin so that said last-mentioned pin is axially movable in said bosses.

6. In the game board of claim 1 wherein said letters on said letter means are dispersed according to the frequency of their appearance in the English language, the total number of letters on all of said letter means thereby containing percentages of each letter in the English language correlated to its frequency of appearance therein.

7. In the game board of claim 6 wherein letter combinations frequently appearing together in the English language are disposed in juxtaposed relationship on said game board.

8. In the game board of claim 1 wherein letter combinations frequently appearing together in the English language are disposed in juxtaposed relationship on said game board.

* * * * *